US005666635A

United States Patent [19]

Kaneko et al.

[11] Patent Number: 5,666,635

[45] Date of Patent: Sep. 9, 1997

[54] FABRICATION METHODS FOR R-FE-B PERMANENT MAGNETS

[75] Inventors: Yuji Kaneko, Uji; Naoyuki Ishigaki, Ootsu, both of Japan

[73] Assignee: Sumitomo Special Metals Co., Ltd., Osaka, Japan

[21] Appl. No.: 523,928

[22] Filed: Sep. 6, 1995

[30] Foreign Application Priority Data

| | | | |
|---|---|---|---|
| Oct. 7, 1994 | [JP] | Japan | 6-270618 |
| Oct. 7, 1994 | [JP] | Japan | 6-270619 |
| Dec. 9, 1994 | [JP] | Japan | 6-331698 |
| Dec. 9, 1994 | [JP] | Japan | 6-331699 |

[51] Int. Cl.[6] ..... B22F 1/00

[52] U.S. Cl. ..... 419/12; 419/23; 419/42; 148/103

[58] Field of Search ..... 419/12, 23, 42; 148/103

[56] References Cited

U.S. PATENT DOCUMENTS 5,527,504 6/1996 Kishimoto et al. .
5,575,830 11/1996 Yamashita et al. .

*Primary Examiner*—Charles T. Jordan
*Assistant Examiner*—Anthony R. Chi
*Attorney, Agent, or Firm*—Watson Cole Stevens Davis, P.L.L.C.

[57] ABSTRACT

This invention, using finely ground powders obtained by either a ingot grinding method, a Ca reduction diffusion method or a strip casting method, proposes a fabrication method for high-performance R—Fe—B permanent magnets with excellent press packing characteristics, a high degree of orientation of the magnetization direction of each crystallite and a total sum of A, (BH)max (MGOe) and B, iHc (kOe), A+B greater than 59.5. Here, cast alloys or ground alloys are coarse ground by mechanical grinding or by a $H_2$ absorption and decomposition method, and then fine ground by either mechanical grinding or by a jet mill grinding process to yield R—Fe—B fine powders with an average particle size of 1.0 μm~10 μm. These powders are then packed into a mold at a packing density of 1.4~3.5 g/cm$^3$, a pulsed magnetic field with a field intensity greater than 10 kOe is applied so as to repeatedly invert the magnetization direction, and finally cold isostatic pressing is performed in a static magnetic field.

21 Claims, No Drawings

FABRICATION METHODS FOR R-FE-B PERMANENT MAGNETS

BACKGROUND OF THE INVENTION

1. Field of the Invention

This invention, relating to fabrication methods for high-performance R—Fe—B permanent magnets with excellent crystal orientation, provides a fabrication method whereby cast and ground alloys of a desired composition obtained either by ingot grinding, Ca reduction diffusion or strip casting, are ground to a coarse and then a fine powder, and packed into a mold at a particular packing density, and whereby, after aligning the magnetic powders by repeatedly applying an instantaneous pulsed magnetic field to invert their magnetic orientation, they undergo cold isostatic pressing, sintering and aging. In particular, it relates to a fabrication method whereby a lubricant is compounded with the coarse powders before fine grinding and cold isostatic pressing is performed in a static magnetic field to obtain high-performance R—Fe—B permanent magnets with excellent orientation and magnetic characteristics such that iHc is greater than 10 kOe, and that the sum of A, the maximum energy product (BH)max(MGOe), which is one characteristic of a magnet, and B, the coercive force iHc (kOe), has a value A+B of more than 59.5.

2. Description of the Prior Art

Currently, good magnetic characteristics can be obtained for typical R—Fe—B permanent magnets used as high-performance permanent magnets (J.P.A. No. SHO-59-46008, U.S. Pat. No. 4,770,723), in compositions consisting of a ternary tetragonal compound as main phase and an R-rich phase, and R—Fe—B permanent magnets of various compositions are used in a wide range of products from general home appliances to computer peripherals, utilizing their many varied magnetic characteristics.

However, the drive for miniaturization and high performance in electrical device has meant a search for high performance and more inexpensive R—Fe—B permanent magnets.

In general, R—Fe—B rare-earth magnets are usually fabricated by either process 1)~3) or process a)~c).

1) For starting materials, fabricating a cast alloy by induction melting of rare-earth metals, electrolytic iron, ferroboron alloy and in addition, electrolytic Co.
2) Forming coarse powders from this cast alloy by $H_2$ absorption and decomposition, and then forming fine powders of 1.0 μm~10 μm either by wet grinding using a ball mill or attrition mill, or by grinding with a jet mill using an inert gas.(J.P.A. No. SHO-60-63304 SHO-63-33505)
3) Pressing, sintering and aging the fine powder.
   a) Using starting materials whereby a mixed oxide or alloy powder of a required composition is compounded from at least one rare-earth oxide, iron powder, and at least one of either pure boron powder, ferroboron powder or boron oxide, or is comprised of the above elements. This material is mixed with metallic Ca and $CaCl_2$, and a reduction diffusion reaction is performed within an inert gas atmosphere. The resulting reaction product is slurrified, and the CaO by-products and $CaCl_2$ flux are removed by a washing treatment.
   b) Wet grinding the resulting products in a ball mill or attrition mill, or dry grinding them in a jet mill to produce fine powders of 1.0 μm~10 μm.
   c) Pressing; sintering and aging the fine powder.

Further, fabrication methods have been proposed (J.P.A. No. SHO-63-317643) whereby, in order to prevent coarsification, residual α-Fe and segregation of R—Fe—B alloy powder crystallites with unavoidable defects formed by the ingot grinding method, that is, a method whereby ingots are pulverized and the resulting ground alloys are mechanically ground to a coarse powder followed by mechanical grinding or grinding in a jet mill, a R—Fe—B molten alloy is formed into a cast alloy of a particular thickness using the twin roller method. Then, following usual metallurgical methods, the cast alloy is ground to a coarse powder by a stamp mill or jaw crusher, and then to a fine powder of average size 3~5 μm by a disk mill, ball mill, attrition mill or jet mill, and then finally pressed in a magnetic field, sintered and aged.

However, using the above method, we cannot achieve a rapid improvement in grinding efficiency compared to prior ingot grinding methods, where ingots were cast into molds, and further, as not only the particle surfaces but also the particle bulk is ground during the fine grinding, we cannot achieve a great improvement in magnetic properties. Also, as the R-rich phase does not form $RH_2$, which is stable against oxidation, the large microscopic surface area of the R-rich phase being microscopic leads to a degradation of the antioxidation properties. As such, oxidation occurs during processing meaning and we cannot obtain good magnetic properties.

As greater cost efficiency is being sought in the production of R—Fe—B permanent magnets, it is necessary to efficiently fabricate raw material powders for high-performance permanent magnets. As such, it is necessary to improve fabrication conditions to produce near theoretical properties.

With the purpose of producing a fabrication method for high-efficiency R—Fe—B permanent magnets whereby, efficient fine grinding is possible to achieve a good iHc due to the fineness of magnetic crystallites with good antioxidation properties and whereby there exists a high degree of orientation of the magnetization direction of each crystallite such that the sum of A, the value of (BH)max (MGOe) and B, the value of iHc (kOe) is $A+B \geqq 59$, the authors have proposed a fabrication method (J.P.A. No. HEI-5-192886) for high-performance R—Fe—B permanent magnets whereby R—Fe—B-type cast alloys of a particular thickness obtained by strip casting are coarse ground by a $H_2$ absorption decay method and then ground by, a jet mill within an inert gas atmosphere, and whereby, the obtained fine powders are packed into a mold at a particular packing density followed by orientation by applying a pulsed magnetic field in a particular direction, instantaneously followed by molding, sintering and an aging treatment.

However, with a purpose of raising the performance of R—Fe—B permanent magnets, in order to improve the packing characteristics within the mold and the degree of orientation,when, for example, the fine powders obtained by the above method are compounded with a lubricant before press molding, it is extremely difficult to uniformly coat the fine powder's surface with a lubricant, and furthermore, imperfections such as variations in weight and cracks during pressing process.

SUMMARY OF THE INVENTION

This invention, which aims to solve the problems in fabricating R—Fe—B permanent magnets related above, proposes a fabrication method for high performance R—Fe—B permanent magnets whereby, fine powders are obtained by any of the methods described above such as ingot grinding, Ca reduction diffusion or strip casting, and the obtained magnets have exceptional press packing characteristics, have a high degree of orientation of the magnetization direction of each crystallite, and a sum of A, the value of (BH)max (MGOe) and B, the value of iHc (kOe) which is A+B≧59.51.

To achieve this, the inventors, after various investigations into grinding, packing, molding and magnetic orientation methods, have obtained high performance permanent magnets whereby, a coarse powder is obtained from either a ground alloy, a cast alloy or the raw material powders by mechanical grinding or by a $H_2$ absorption decay method and whereby a fine powder, with an average particle size of 1.0 μm~10 μm, obtained by mechanical grinding or a jet mill, is packed into a mold at a packing density of 1.4~3.5 g/cm$^3$. After applying a pulsed magnetic field with a field intensity greater than 10 kOe to repeatedly invert the magnetization direction, cold isostatic pressing is performed in a static magnetic field which results in high performance permanent magnets with an excellent degree of orientation, magnetic characteristics with iHc greater than 10 kOe and a sum of A, the value of the maximum energy product, (BH)max (MGOe),which is a magnetic characteristic, and B, the value of coercive force iHc (kOe) is A+B≧59.5.

This invention, wherein cast alloys or ground alloys, obtained by ingot grinding, Ca reduction diffusion or strip casting, are coarse ground by mechanical grinding or a $H_2$ absorption decay method, and wherein these coarse powders or the raw material powders are compounded with a solid type or a liquid type lubricant and then fine ground by a jet mill, enables the production of powders with good flowability and an uniform particle distribution together with a reduction in the particle size of the main phase crystallites which constitute the alloy ingot. Here, for fine grinding of alloy powders, in which the R-rich phase is finely distributed, and the size of the $R_2Fe_4B$ phase is reduced and which have been stabilized by an $H_2$ removal treatment, and whereby the powders have been compounded with a particular lubricant, the fabrication efficiency is greatly improved due to an approximately twofold increase in the fine grinding efficiency. Here, by packing the above fine powders into a mold, applying a pulsed magnetic field which is repeatedly inverted to orientate the powder crystallites, and by cold isostatic pressing, particularly in a static magnetic field, followed by molding and sintering, we can obtain R—Fe—B permanent magnets with improved press packing characteristics and magnetic orientation, as well as improved magnetic characteristics such as Br, (BH)max and particularly iHc, of the magnetic alloy.

DETAILED DESCRIPTION OF PREFERRED EMBODIMENTS

Cast alloys for the present invention are fabricated by the strip casting method using either a single roller or a twin roller. The obtained cast alloy is a thin plate with a thickness of 0.03 mm~10 mm with either a single roller or a twin roller being used depending on the plate thickness. For thick plates a twin roller is suitable, while for a thin plate a single roller is suitable.

The plate thickness is limited to 0.03 mm~10 mm because of the following. For a thickness less than 0.03 mm, the quenching effect is large resulting in crystallites smaller than 3 μm, and as these crystallites are easily oxidized when powdered, a deterioration in the magnetic characteristics results. For a thickness exceeding 10 mm, the cooling speed is slow and α-Fe will easily crystallize, causing the crystallite size to become large, and a segregation of the Nd-rich phase to occur, causing a deterioration in the magnetic characteristics.

The cross-sectional structure of the R—Fe—B alloy of a particular composition obtained by the strip casting method of the present invention has main phase $R_2Fe_{14}B$ crystals less than one tenth the size of those in ingots obtained by conventional casting. For example, fine crystals with a short axis dimension of 0.1 μm~50 μm and a long axis dimension of 5 μm~200 μm are obtained, and the R-rich phase which surrounds these main phase crystals will also be finely distributed, and even if there is an area of local segregation, it is of a size less than 20 μm.

For the coarse grinding $H_2$ absorption treatment of the present invention, the cast alloy is placed in a sealed container, and after producing a sufficient vacuum, 200 Torr~50 kg/cm$_2$ pressure of $H_2$ gas is supplied and $H_2$ is absorbed into the cast alloy.

As the $H_2$ absorption reaction is an exothermic reaction, cooling tubes around the container exterior supply cooling water to prevent a temperature rise within the container, and by supplying $H_2$ gas at the required pressure for a required time, the $H_2$ gas will be absorbed and the said cast alloy will spontaneously decompose and be powdered. Further, after cooling the powdered alloy, a $H_2$ removal treatment is performed in vacuum.

As fine cracks exist within the particles of the alloy powders obtained by the above method, they may be fine ground by a ball mill or jet mill in a short time period and we can obtain alloy powders of the required size of 1 μm~10 μm.

For the present invention, within the above treatment container, one may replace the air with an inert gas beforehand, and then replace that inert gas with $H_2$ gas.

The smaller the size of the ground ingots, the smaller the pressure required for $H_2$ grinding, and ingots pulverized under reduced pressure will absorb $H_2$ and be powdered. If the pressure of the $H_2$ gas is greater than atmospheric pressure, powdering will occur easily. However, at less than 200 Torr, the powdering characteristics are poor, and for more than 50 kg/cm$^2$, although this is the best point for powdering due to $H_2$ absorption, it is undesirable due to the safety aspects of the equipment and production. Thus, a $H_2$ gas pressure of 200 Torr~50 kg/cm$^2$ is chosen and for mass production, 2 kg/cm$^2$~10 kg/cm$^2$ is preferable.

For the present invention, the treatment time for powdering by $H_2$ absorption varies with the size of the said sealed container, the size of the ground ingots and the $H_2$ gas pressure, but more than five minutes will be necessary.

After cooling the alloy powders powdered by $H_2$ absorption, a first $H_2$ gas removal treatment is performed under vacuum. Then, a second $H_2$ gas removal treatment is performed by heating the powdered alloy to 100° C.~750° C. in vacuum or in an argon atmosphere for more than 0.5 hours. This treatment completely removes any $H_2$ gas from the powdered alloy and prevents oxidation of the powder or press molded product during long storage, thus preventing a deterioration of the magnetic properties of the permanent magnet.

For the hydrogen removal treatment of the present invention, as heating to over 100° C. yields exceptional hydrogen removal results, it is possible to omit the first hydrogen removal treatment in vacuum and instead perform a hydrogen removal treatment in vacuum or in an argon atmosphere whereby the pulverized powder is directly heated to over 100° C.

Therefore, after the $H_2$ absorption/pulverization reaction has occurred in the $H_2$ absorption container, it is possible to perform the hydrogen removal treatment by heating the pulverized powders to over 100° C. within the atmosphere of the same container. Alternatively, after performing the hydrogen removal treatment in vacuum, one may remove the pulverized powder from the treatment container, fine grind it, and then again perform the hydrogen removal treatment of heating to over 100° C. within the treatment container.

Regarding the heating temperature of the above hydrogen removal treatment, a temperature of less than 100° C. is not suitable for mass production as, although the $H_2$ within the pulverized alloy powders is removed, a long time is required to achieve this. Further, at temperatures exceeding 750° C. a liquid phase appears, causing difficulties in fine grinding due to solidification of the powder. As this results in a worsening of molding characteristics when pressing it is undesirable for the fabrication of sintered magnets.

Thus, considering the sintering characteristics of the sintered magnets, the temperature for the hydrogen removal treatment is between 200° C.~600° C. Further, a treatment time of more than 0.5 hours is required, changing depending on the amount to be treated.

Further hydrogen removal treatment of the pulverized powders obtained by the above $H_2$ absorption and decomposition reaction yields coarse powders with an average particle size of 101 μm~500 μm. Then, after mixing in 0.02~5 wt % of lubricant, the alloy crystallites are reduced in size by a jet mill to produce fine powders with an average particle size of 1~10 μm having excellent flowability.

Therefore, by mixing coarse powders of the required composition with a prescribed liquid or solid lubricant and grinding in a jet mill, the fine powder surfaces will be uniformly covered by lubricant after fine grinding, which improves both the grinding efficiency and the press packing characteristics. This also prevents weight variations and cracks that previously appeared when press molding and yields magnets with an excellent degree of orientation.

For the liquid lubricant added before fine grinding in the present invention, at least one of either a saturated or unsaturated fatty acid ester, and an acid such as boric acid ester may be chosen, which are dispersed in either a petroleum-based or alcohol-based solvent.

A quantity of 5 wt %~50wt % of fatty acid ester within the liquid lubricant is desirable.

Saturated fatty acid esters may be represented by the general formula $$RCCOR', \text{ where } R=C_nH_{2n+2n} \text{ (alkane)},$$

and unsaturated fatty acid esters may be represented by the general formula $$RCOOR', \text{ where } R=C_nH_{2n} \text{ (alkene) or}$$

$$R=C_nH_{2n-2} \text{ (alkyne)}.$$

For solid lubricants, at least one of either zinc stearate, copper stearate, aluminium stearate or ethylene-vinylamido may be used. As for the average particle size of the solid lubricant, for a size of less than 1 μm, there will be production difficulties and for a size exceeding 50 μm it is difficult to evenly mix the lubricant with the coarse powder. As such, an average particle size of 1 μm~50 μm is desirable.

For the amount of liquid or solid lubricant added in the present invention, an amount of less than 0.02 wt % provides an insufficient uniform covering of the powder particles meaning the press packing characteristics and degree of magnetic orientation are not improved, while an amount exceeding 5 wt % results in involitile residual lubricant remaining within the sintered products which causes a fall in the sintered density leading to a deterioration in the magnetic characteristics. As such the amount of added lubricant is 0.02 wt %~5 wt %.

The reasons why the average particle size of the coarse powders is limited to 10 μm~500 μm in the present invention are as follows. For an average particle size of less than 10 μm the alloy powders cannot be handled safely in the atmosphere and a deterioration in the magnetic properties due to oxidation of the powder particles can result. Further, for an average particle size exceeding 500 μm, there are difficulties in supplying the alloy powders to the jet mill resulting in a remarkable drop in grinding efficiency. As such, the average particle size is 10 μm~500 μm.

Next, fine grinding is performed by a jet mill using an inert gas (for example, $N_2$ or Ar). It is also possible to use a ball mill or an attrition mill using an organic solvent (for example, benzene or toluene).

For the average particle size of the fine powders of the present invention, a size of less than 1.0 μm yields powders which are extremely active, resulting in the danger of flammability during processes such as press molding and a deterioration in the magnetic properties, while a size exceeding 10 μm causes the permanent magnet crystallites obtained by sintering to be large, and reversal of magnetization can easily occur resulting in a decrease in the coercive force. As such, the most desirable average particle size is 2.5 μm~4 μm.

The finely ground powders are packed into a mold suitably under an inert gas atmosphere. Molds can be fabricated from nonmagnetic metals, oxides or ceramics, or alternatively, organic compounds such as resins and rubbers including natural rubber, chloroprene rubber, urethane rubber, silicon rubber or nitrile rubber can be used.

It is preferable for the packing density of the powder to be in the range of the apparent density of the stationary powder (packing density 1.4 g/cm$^3$) to the apparent tapping density of the compacting powder (packing density 3.5 g/cm$^3$). Therefore, the packing density is limited to 1.4~3.5 g/cm$^3$.

For permanent magnets in general, the alignment of the magnetization directions of the main phase crystallites, that is achieving a high degree of orientation is a necessary condition to obtain a large Br. As such, permanent magnets fabricated by powder metallurgical methods, for example hard ferrite magnets, Sm–Co magnets or R—Fe—B magnets, require powders to be pressed in a magnetic field.

However, coils and power supplies attached to conventional presses (hydraulic presses or mechanical presses) to generate magnetic fields can only generate fields of at most 10 kOe~20 kOe, and in order to generate larger magnetic fields it is necessary to improve equipment to have coils with a greater number of turns or with larger power supplies.

The present inventors have analyzed the relationship between magnetic field intensity at the time of pressing and the magnetic characteristic Br of the sintered products. They have found that a large Br can be obtained by using a strong magnetic field intensity, and that by applying a pulsed magnetic field in a constant direction, whereby a strong magnetic field can be instantaneously generated, an even larger Br can be obtained. Further, by applying a pulsed magnetic field where the magnetization direction is repeatedly alternately inverted, the degree of orientation of the alloy powder crystals can be further improved along with the magnetic characteristics.

For methods using a pulsed magnetic field, instantaneous orientation by a pulsed magnetic field where the magnetization direction is repeatedly alternately inverted, is important, and where it is possible to mold the powders using a cold isostatic press, the crystal orientation characteristics can be further improved by pressing in a static magnetic field.

For the repeatedly inverted pulsed magnetic field of the present invention, a pulsed magnetic field intensity of greater than 10 kOe, and preferable between 20~60 kOe, generated by an air core coil and a condenser power supply, is used, and although a magnetic field intensity lower than that of conventional pulsed magnetic fields with a constant direction is applied, similar results can be obtained.

A pulse width should be between 1 μsec~10 sec, with 5 μm~100 msec most desirable. The waveform of the repeatedly inverted pulsed magnetic field is obtained by applying the electrical field in the opposite direction to the voltage and the repeatedly inverted pulsed magnetic field should be applied 1~10 times, with 2~8 times being desirable.

Further, for a pulse shape of the pulsed magnetic field of the present invention, a pulse shape of the same intensity may be repeatedly inverted, or, the peak value for the pulse shape may be applied at a value which is gradually reduced from the starting value.

For the present invention, the orientated powders are molded by conventional pressing methods in the magnetic field, with cold isostatic pressing being preferable. Here, when using a rubber or other mold with plasticity, cold isostatic press molding may be performed as is. Cold isostatic press molding is most suitable for the fabrication of large magnets.

Conditions for cold isostatic press molding are desirable at a press pressure of 1 ton/cm$^2$~3 ton/cm$^2$ and a mold hardness of Shore hardness Hs=20~80.

Further, cold isostatic pressing may be performed in a static magnetic field. For example, after applying a repeatedly inverted magnetic field of the same strength to orientate the powder particles, by performing cold isostatic pressing on the orientated powders in a static magnetic field, it is possible to obtain high performance R—Fe—B permanent magnets having a total sum of the aforementioned magnetic characteristics A+B greater than 62.

For the present invention, known powder metallurgical methods and conditions for molding, sintering and aging may be used. An example of favorable conditions is given below.

For molding, known molding methods may be applied, with compression molding at a pressure of 1.0~3.0 ton/cm$^2$ being favorable for cold isostatic pressing. Further, for molding while applying a static magnetic field, a field intensity in the range of 5~20 kOe is favorable.

For sintering, general methods of heating in vacuum may be used and it is suitable to perform a binder removal treatment by raising the temperature by 100°~200° C. per hour under a hydrogen flow and keeping at 300°~600° C. for 1~2 hours. By performing a binder removal treatment almost all the carbon within the binder is removed, resulting in improved magnetic characteristics.

Furthermore, as alloy powders containing R-elements easily absorb hydrogen, it is suitable to perform a hydrogen removal treatment after the binder removal treatment under a hydrogen flow. For the hydrogen removal treatment, by raising the temperature at a rate of 50°~200° C. per hour and maintaining at 500°~800° C. for 1~2 hours under vacuum, the absorbed hydrogen can be almost completely removed.

It is preferable to perform sintering by continuing to raise the temperature after the hydrogen removal treatment is completed, and once the temperature exceeds 500° C., a heating rate, such as 100°~300° C. per hour may be optionally chosen, and known sintering methods may be applied.

Conditions for sintering and annealing the orientated molded products are determined according to the composition of the selected alloy powders with a temperature of 1000°~1180° C. maintained for 1~2 hours suitable for sintering and a temperature of 450°~800° C. maintained for 1~8 hours suitable for aging.

Reasons for restricting the composition.

Below the reasons for restricting the compositions of the R—Fe—B permanent magnet alloy powders of the present invention are detailed.

The rare-earth elements R contained in the permanent magnet alloy powders of the present invention include yttrium (Y) and include both light rare-earth elements and heavy rare-earth elements.

The light rare-earths are sufficient as R, with Nd or Pr being preferable. Although only one R element is sufficient, in practice a mixture of two or more elements (mischmetal, didymium) may be used for convenience, such as a mixture of Sm, Y, La, Ce and Gd, with Nd and Pr as other R-elements. Furthermore, it is not necessary to use pure rare-earth elements for R, and elements containing unavoidable impurities from the fabrication process that are easily obtainable may also be used.

R is an indispensable element in alloy powders for the fabrication of R—Fe—B permanent magnets, and for less than 10 at % good magnetic properties, in particular a high coercive force, cannot be obtained. For in excess of 30 at %, the residual magnetic flux density (Br) falls and magnets with exceptional properties cannot be obtained. Thus, R is in the range 10 at %~30 at %.

B is an indispensable element in alloy powders for the fabrication of R—Fe—B permanent magnets, and for less than 2 at % a large coercive force (iHc) cannot be obtained while for in excess of 28 at %, the residual magnetic flux density (Br) falls and magnets with excellent properties cannot be obtained. Thus, B is in the range 2 at %~28 at %.

For Fe, at less than 42 at % the residual magnetic flux density (Br) falls, and for in excess of 88 at % a large coercive force can not be obtained. Thus Fe is limited to 42 at %~88 at %.

By partially replacing Fe with either or both Co or Ni, the thermal and anticorrosive properties of the magnet can not be improved. However, if the amount of either or both of Co or Ni is in excess of 50% of Fe, a large coercive force and excellent magnets cannot be obtained. Thus, the upper limit for the amount of either or both of Co or Ni is 50% of Fe.

In order to obtain excellent permanent magnets with a large residual magnetic flux density and coercive force, the desirable composition for the alloy powders of the present invention is R: 12 at %~16 at %, B: 4 at %~12 at % and Fe: 72 at %~84 at %.

For the alloy powders of the present invention, unavoidable impurities other than the aforesaid R, B and Fe from the industrial process may be tolerated, and by partially replacing B with at least one of up to 4.0 at % C, up to 3.5 at % P, up to 2.5 at % S, or up to 3.5 at % Cu, with a total amount up to 4.0 at %, it is possible to improve the fabrication and cost efficiency of the magnetic alloys.

Further, for R—Fe—B alloys containing the aforesaid R, B and Fe as well as either or both Co or Ni, by adding at least one of up to 9.5 at % Al, up to 4.5 at % Ti, up to 9.5 at % V, up to 8.5 at % Cr, up to 8.0 at % Mn, up to 5.0 at % Bi, up to 12.5 at % Nb, up to 10.5 at % Ta, up to 9.5 at % Mo, up to 9.5 at % W, up to 2.5 at % Sb, up to 7 at % Ge, up to 3.5 at % Sn, up to 5.5 at % Zr or up to 5.5 at % Hf, it is possible to obtain permanent magnet alloys with a large coercive force.

For the R—Fe—B permanent magnets of the present invention, it is essential that the crystal phase has a tetragonal main phase, and this is particularly effective in obtaining microscopically uniform alloy powders to produce sintered permanent magnets with excellent magnetic characteristics.

This invention is able to obtain extremely high performance magnets whereby R—Fe—B alloy powders are obtained by either ingot grinding, Ca reduction diffusion or strip casting, and whereby the obtained cast alloys and ground alloys are coarsely ground by mechanical grinding or $H_2$ absorption and decomposition and then finely ground by mechanical grinding or a jet mill to obtain fine R—Fe—B powders, and whereby fine powders of an average particle size of 1.0 μm~10 μm are packed into a mold at a packing density of 1.4–3.5 g/cm$^3$, and a pulsed magnetic field with a field intensity greater than 10 kOe is applied to repeatedly invert the magnetic direction, and whereby cold isostatic pressing is performed in a static magnetic field. As such, we can obtain high-performance R—Fe—B permanent magnets with excellent orientation and magnetic characteristics such that iHc is greater than 10 kOe, and that the sum of A, the maximum energy product (BH)max(MGOe), which is one characteristic of a magnet, and B, the coercive force iHc (kOe), has a value A+B of more than 59.5.

In particular, fabrication by strip casting, $H_2$ absorption and decomposition and a $H_2$ removal treatment followed by mixing with a desired lubricant and fine grinding in a jet mill makes it possible to reduce the size of the main phase crystallites that comprise the alloy ingots and it is possible to fabricate powders with a uniform particle distribution at an efficiency about twice that of previous methods. Thus we can efficiently fabricate extremely high performance R—Fe—B permanent magnets with excellent press packing characteristics and a high degree of orientation of the magnetization direction of each crystallite.

EMBODIMENTS

Example 1

Using 99.9% pure electrolytic iron, ferroboron alloy containing 19.5 wt % B and greater than 99.7% pure Nd and Dy as starting materials, an ingot with the composition 12.4 at % Nd, 1.4 at % Dy, 6.7 at % B, 79.5 at % Fe was obtained by compounding the starting materials, using induction melting and casting in a water-cooled copper cast.

Then, after grinding the said ingot by a stamp mill, a coarse powder with an average particle size of 40 μm was obtained by further $H_2$ absorption and decomposition. The obtained coarse powder was fine ground using a jet mill with $N_2$ gas at a pressure of 7 kg/m$^2$, and a fine powder with an average particle size of 3 μm was obtained. The grinding efficiency in this case is shown in Table 1.

After packing the obtained fine powders in a rubber mold formed from urethane at a packing density of 3.0 g/cm$^3$, a pulsed magnetic field, with a field intensity of 30 kOe and with the pulse width of 15/100 seconds, was applied to repeatedly invert the N and S poles four times.

After obtaining a molded sample with the dimensions λ25×20 mm from the orientated sample by cold isostatic pressing at a press pressure of 1.5 Ton/cm$^2$, the molded sample was sintered under an Ar atmosphere at 1060° C. for four hours and aged under an Ar atmosphere at 600° C. for one hour. The magnetic characteristics of the obtained sample were measured with the results shown in Table 2.

Example 2

1 wt % of fatty acid ester liquid lubricant (boiling point 180° C., active component 25 wt %; cyclohexane 75 wt %) was added to coarse powders obtained with the same composition and conditions as for example 1, after which a fine powder with an average particle size of 3 μm was obtained by a jet mill under the same conditions as for example 1. The grinding efficiency in this case is shown in Table 1.

After packing the obtained fine powders in a rubber mold and applying a repeatedly inverted pulsed magnetic field under the same conditions as for example 1, cold isostatic pressing, sintering and aging was carried out under the same conditions as for example 1. The magnetic characteristics of the obtained sample are shown in Table 2.

Example 3

Fine powder, obtained with the same composition and conditions as for example 1, was packed into a rubber mold, and repeatedly inverted pulsed magnetic field was applied under the same conditions as for example 1, after which cold isostatic pressing in a static magnetic field of 10 kOe and at a pressure of 1.5 Ton/cm$^2$ was carried out to obtain a molded sample with the same dimensions as for example 1. Sintering and aging treatments were carried out on the said molded sample under the same conditions as for example 1, and the measurement results on the magnetic characteristics are shown in Table 2.

Example 4

A cold isostatic pressing treatment in a static magnetic field under the same conditions as for example 3 was performed to a sample, obtained with the same composition and conditions as for example 2, and to which a repeatedly inverted pulsed magnetic field had been instantaneously applied, after which sintering and aging was performed under the same conditions as for example 1. The obtained magnetic characteristics are shown in Table 2.

Comparative example 1

Fine powder obtained with the same composition and conditions as for example 1, was packed into a metal mold and the sample was orientated in a magnetic field of 10 kOe and molded perpendicular to the magnetic field under a pressure of 1.5 Ton/cm$^2$. A molded sample with dimensions 15 mm×20 mm×8 mm was obtained and sintering and aging was performed under the same conditions as for example 1. The magnetic characteristics of the sample were measured and the results shown in Table 2.

Comparative example 2

Fine powder obtained with the same composition and conditions as for example 1, was packed into a rubber mold, after which a pulsed magnetic field with a field strength of 30 kOe was instantaneously applied in a constant direction, followed by cold isostatic pressing, sintering and aging under the same conditions as for example 1. The magnetic characteristics of the sample were measured and the results shown in Table 2.

Comparative example 3

Fine powder obtained with the same composition and conditions as for example 2, was packed into a rubber mold, after which a pulsed magnetic field with a field strength of 30 kOe was instantaneously applied in a constant direction, followed by cold isostatic pressing, sintering and aging under the same conditions as for example 1. The magnetic characteristics of the sample were measured and the results shown in Table 2.

TABLE 1

| | Grinding Efficiency (kg/Hr) | Average particle size (μm) |
|---|---|---|
| Example 1 | 16 | 3.3 |
| Example 2 | 20 | 3.2 |

TABLE 2

| | Packing density ($g/cm^3$) | Magnetic characteristics Br (kG) | Hc (kOe) | (BH)max (MGOe) A | iHc (kOe) B | A + B | sintered density ($g/cm^3$) |
|---|---|---|---|---|---|---|---|
| Example 1 | 3.0 | 13.1 | 12.2 | 40.8 | 19.2 | 60.0 | 7.60 |
| Example 2 | 3.2 | 13.4 | 12.6 | 42.0 | 18.3 | 60.3 | 7.59 |
| Example 3 | 2.8 | 13.3 | 12.5 | 41.5 | 18.6 | 60.1 | 7.60 |
| Example 4 | 3.2 | 13.5 | 12.8 | 42.5 | 17.9 | 60.4 | 7.60 |
| Comparative Example 1 | 3.0 | 12.5 | 11.5 | 35.0 | 18.4 | 53.4 | 7.59 |
| Comparative Example 2 | 3.0 | 12.8 | 12.0 | 37.5 | 18.2 | 56.7 | 7.61 |
| Comparative Example 3 | 3.0 | 12.9 | 12.1 | 38.3 | 17.8 | 56.1 | 7.60 |

Example 5

160 g of 99% pure metallic Ca and 25 g of anhydrous $CaCl_2$ were mixed with 343 g of $Nd_2O_3$ (99% pure)

48 g of $Dy_2O_3$ (99.9% pure)

60 g of Fe—B powder containing 19.1 wt % B 50 g of Co powder (99.9% pure)

570 g of Fe powder (99.9% pure)

in a direct reduction diffusion method, inserted into a stainless steel container, and a Ca reduction diffusion reaction was carried out under flowing Ar at 1000° C. for three hours.

Then, after cooling, the reaction product was washed and the excess Ca was removed. The obtained powder slurry was washed with alcohol to remove water and dried under vacuum to yield approximately 960 g of raw powder.

The thus obtained powder consisted of 12.8 at % Nd, 0.2 at % Pr, 1.6 at % Dy, 6.7 at % B, 5.7 at % Co with the remainder Fe, and was of an average particle size of 20 lain, and had an oxygen content of 1800 ppm.

This raw powder was fine ground to a size of 3 μm in a jet mill, after which the obtained fine powders were packed into a silicon-type rubber mold at a packing density of 3.0 $g/cm^3$, and a repeatedly inverted pulsed magnetic field with a field strength of 35 kOe and a pulse width of 5 sec was applied eight times. This was followed by cold isostatic pressing at a press pressure of 2.0 $Ton/cm^2$, sintering at 1100° C. for two hours under an Ar atmosphere and aging at 500° C. for two hours. The magnetic characteristics of the obtained sample are shown in Table 3.

Example 6

Raw powders, obtained by a direct reduction diffusion method using the same compositions and conditions as for example 5, were compounded with 0.1 wt % zinc stearate, a solid lubricant. This was followed by, jet mill grinding under the same conditions as for example 5 to obtain fine powders with an average particle size of 3 μm, the application of a repeatedly inverted pulsed magnetic field under the same conditions as for example 5, cold isostatic pressing, sintering and aging. The magnetic characteristics of the obtained sample were measured and are shown in Table 3.

Example 7

Fine powders were obtained using the same compositions and conditions as for example 5, followed by, the application of a repeatedly inverted pulsed magnetic field under the same conditions as for example 5, cold isostatic pressing in a static magnetic field of intensity 8 kOe under the same conditions as for example 5, sintering and aging. The magnetic characteristics of the obtained sample were measured and are shown in Table 3.

Example 8

Fine powders were obtained using the same compositions and conditions as for example 6, followed by, the application of a repeatedly inverted pulsed magnetic field under the same conditions as for example 5, cold isostatic pressing in a static magnetic field under the same conditions as for example 7, sintering and aging. The magnetic characteristics of the obtained sample were measured and are shown in Table 3.

Comparative example 4

Fine powders, obtained using the same compositions and conditions as for example 5, were packed into a metal mold, orientated in a 10 kOe magnetic field and molded perpendicular to the magnetic field with an applied pressure of 2 $T/cm^2$ to obtain a molded sample product which was sintered and aged under the same conditions as for example 5. The magnetic characteristics of the obtained sample were measured and are shown in Table 3.

Comparative example 5

Fine powders, obtained using the same compositions and conditions as for example 5, were packed into a rubber mold, and a pulsed magnetic field with a field intensity of 35 kOe was instantaneously applied in a constant direction, followed by cold isostatic pressing under the same conditions as for example 5, sintering and aging. The magnetic characteristics were measured and are shown in Table 3.

Comparative example 6

Fine powders, obtained using the same compositions and conditions as for example 6, were packed into a rubber mold, and a pulsed magnetic field with a field intensity of 35 kOe was instantaneously applied in a constant direction, followed by cold isostatic pressing under the same conditions as for example 5, sintering and aging. The magnetic characteristics were measured and are shown in Table 3.

TABLE 3

| | Packing density ($g/cm^3$) | Magnetic characteristics Br (kG) | Hc (kOe) | (BH)max (MGOe) A | iHc (kOe) B | A + B | sintered density ($g/cm^3$) |
|---|---|---|---|---|---|---|---|
| Example 5 | 2.8 | 12.9 | 12.2 | 38.8 | 21.5 | 60.3 | 7.62 |
| Example 6 | 2.9 | 13.0 | 12.3 | 40.0 | 21.3 | 61.3 | 7.62 |
| Example 7 | 2.8 | 13.1 | 12.4 | 39.5 | 21.4 | 60.9 | 7.62 |
| Example 8 | 2.9 | 13.2 | 12.5 | 40.8 | 20.7 | 61.5 | 7.62 |

TABLE 3-continued

| | Packing density ($g/cm^3$) | Magnetic characteristics Br (kG) | Hc (kOe) | (BH)max (MGOe) A | iHc (kOe) B | A + B | sintered density ($g/cm^3$) |
|---|---|---|---|---|---|---|---|
| Comparative Example 4 | 2.4 | 12.3 | 11.3 | 34.5 | 21.8 | 56.3 | 7.62 |
| Comparative Example 5 | 2.8 | 12.7 | 11.9 | 37.8 | 21.4 | 59.2 | 7.62 |
| Comparative Example 6 | 2.9 | 12.8 | 11.9 | 38.0 | 21.3 | 59.3 | 7.62 |

Example 9

A molten alloy with a composition 13.6 Nd-0.4 Dy-6.1 B-79.9 Fe obtained by induction melting, was strip cast using a twin roller consisting of two copper rolls of diameter 200 mm to yield a thin plate cast alloy with a thickness of 1 mm. The short-axis dimension of the crystal grains within the said cast alloy was 0.5 μm~15 μm while the long-axis dimension was 5 μm~80 μm. The R-rich phase surrounding the main phases was finely separated with a size of about 3 μm.

The said cast alloy was then fractured into pieces of no more than 50 mm square and 1000 g of the said fractured pieces were inserted into a ventilated sealed container. The air in the said container was first replaced by flowing $N_2$ gas for 30 minutes, and 3 $kg/cm^2$ of $H_2$ gas was supplied over two hours into the said container causing the cast alloy to spontaneously decompose due to $H_2$ absorption. A hydrogen removal treatment was then performed in vacuum by maintaining for five hours at 500° C., and after cooling to room temperature, the powders were further ground to a 100 mesh.

Next, the said coarse powders were ground in a jet mill to obtain fine powders with an average particle size of 3 μm. The thus obtained alloy powders were packed into a urethane rubber mold at a packing density of 3.2 $g/cm^3$, and a repeatedly inverted pulsed magnetic field with a field intensity of 50 kOe and a pulse width of 8 sec was applied four times, followed by cold isostatic pressing at a press pressure of 1.0 $Ton/cm^2$. The molded sample product was removed from the mold and sintered for three hours at 1050° C. and aged for one hour at 550° C. to yield a permanent magnet. The magnetic properties of the obtained permanent magnet are shown in Table 4.

Example 10

Coarse powders, obtained using the same compositions and conditions as for example 9, were compounded with 0.1 wt % zinc stearate, a solid lubricant, and fine ground using a jet mill in 7 $kg/cm^2$ of Ar gas to yield alloy powders with an average particle size of 3.2 μm.

A repeatedly inverted pulsed magnetic field was applied to the obtained fine powders under the same conditions as for example 9, followed by cold isostatic pressing, sintering and aging. The magnetic properties of the obtained permanent magnet are shown in Table 4.

Example 11

Fine powders, obtained using the same compositions and conditions as for example 9, were packed into a nitrile rubber mold at a packing density of 3.4 $g/cm^3$, and a repeatedly inverted pulsed magnetic field was applied under the same conditions as for example 9, followed by cold isostatic pressing in a static magnetic field of 12 kOe at a press pressure of 1.0 $kg/cm^2$ to obtained a molded sample which was then sintered and aged under the same conditions as for example 9. The magnetic properties of the obtained permanent magnet are shown in Table 4.

Example 12

A repeatedly inverted pulsed magnetic field was instantaneously applied to a sample obtained using the same compositions and conditions as for example 10, followed by cold isostatic pressing in a static magnetic field under the same conditions as for example 11, and sintering and aging under the same conditions as for example 9. The magnetic properties of the obtained sample are shown in Table 4.

Comparative example 7

Fine powders, obtained using the same compositions and conditions as for example 9, were packed into a metal mold, orientated within a 10 kOe magnetic field, molded perpendicular to the magnetic field at a pressure of 1.0 $T/cm^2$, followed by sintering and aging under the same conditions as for example 9. The magnetic properties of the obtained sample are shown in Table 4.

Comparative example 8

Fine powders, obtained using the same compositions and conditions as for example 9, were packed into a rubber mold, and a pulsed magnetic field of field intensity 50 kOe was instantaneously applied in a constant direction to the sample, followed by cold isostatic pressing, sintering and aging under the same conditions as for example 9. The magnetic properties of the obtained sample are shown in Table 4.

Comparative example 9

Fine powders, obtained using the same compositions and conditions as for example 10, were packed into a rubber mold, and a pulsed magnetic field of field strength 50 kOe was instantaneously applied in a constant direction to the sample, followed by cold isostatic pressing, sintering and aging under the same conditions as for example 9. The magnetic properties of the obtained sample are shown in Table 4.

TABLE 4

| | Packing density ($g/cm^3$) | Magnetic characteristics Br (kG) | Hc (kOe) | (BH)max (MGOe) A | iHc (kOe) B | A + B | sintered density ($g/cm^3$) |
|---|---|---|---|---|---|---|---|
| Example 9 | 3.3 | 13.8 | 12.9 | 45.5 | 15.3 | 60.8 | 7.57 |
| Example 10 | 3.3 | 13.9 | 13.0 | 46.5 | 15.1 | 61.6 | 7.58 |
| Example 11 | 3.3 | 14.0 | 13.2 | 47.2 | 14.9 | 62.1 | 7.58 |
| Example 12 | 3.3 | 14.2 | 13.4 | 48.0 | 14.5 | 62.5 | 7.58 |
| Comparative Example 7 | 2.3 | 13.2 | 11.9 | 41.5 | 15.5 | 57 | 7.57 |
| Comparative Example 8 | 3.3 | 13.6 | 12.5 | 44.0 | 15.3 | 59.3 | 7.58 |
| Comparative Example 9 | 3.3 | 13.7 | 12.6 | 44.2 | 15.1 | 59.3 | 7.58 |

We claim:

1. A fabrication method for R—Fe—B permanent magnets, whereby R—Fe—B magnet fine powders with an average particle size of 1.0~10 μm are packed into a mold, and orientated by application of a repeatedly inverted pulsed magnetic field, and whereby this is followed by cold isostatic pressing, sintering and aging treatments.

2. A fabrication method for R—Fe—B permanent magnets in accordance with claim 1, whereby R—Fe—B magnet fine powders are packed into a mold at a packing density of 1.4~3.5 g/cm$^3$.

3. A fabrication method for R—Fe—B permanent magnets in accordance with claim 1, whereby a repeatedly inverted pulsed magnetic field, with a field intensity greater than 10 kOe and a pulse width of 1 μsec~10 sec, is repeatedly inverted and applied 1~10 times.

4. A fabrication method for R—Fe—B permanent magnets in accordance with claim 3, whereby a repeatedly inverted pulsed magnetic field, with a field intensity of 20~60 kOe and a pulse width of 5 μsec~100 msec, is repeatedly inverted and applied 2~8 times.

5. A fabrication method for R—Fe—B permanent magnets in accordance with claim 1, whereby cold isostatic pressing is performed at a press pressure of 1 Ton/cm$^2$~3 Ton/cm$^2$, using a cold isostatic press mold with a hardness of Shore hardness (Hs) 20~80.

6. A fabrication method for R—Fe—B permanent magnets in accordance with claim 1, whereby cold isostatic pressing is performed in a static magnetic field.

7. A fabrication method for R—Fe—B permanent magnets in accordance with claim 6, whereby magnetic field intensity of the static magnetic field is 5~20 kOe.

8. A fabrication method for R—Fe—B permanent magnets in accordance with claim 1, whereby either a ground alloy, obtained by pulverizing an ingot, or a cast alloy, obtained by a strip casting method, are coarse ground by mechanical grinding or by a $H_2$ absorption and decomposition method, and then fine ground by mechanical grinding or by a jet mill to obtain magnet fine powders.

9. A fabrication method for R—Fe—B permanent magnets in accordance with claim 8, whereby coarse powders obtained by a $H_2$ absorption and decomposition method are heated to 100° C.~750° C. to perform a $H_2$ removal treatment.

10. A fabrication method for R—Fe—B permanent magnets in accordance with claim 1, whereby raw powders, obtained by a Ca reduction diffusion method, are fine ground by mechanical grinding or by a jet mill to obtain magnet fine powders.

11. A fabrication method for R—Fe—B permanent magnets in accordance with claim 10, whereby raw powders or coarse powders with an average particle size of 10~500 μm are compounded with 0.02~5.0 wt % of a lubricant, and then fine ground.

12. A fabrication method for R—Fe—B permanent magnets in accordance with claim 11, whereby the lubricant is a liquid lubricant.

13. A fabrication method for R—Fe—B permanent magnets in accordance with claim 12, whereby the liquid lubricant is a lubricant in which at least one of either a fatty acid ester or a boric acid ester is dissolved.

14. A fabrication method for R—Fe—B permanent magnets in accordance with claim 11, whereby the lubricant is a solid lubricant.

15. A fabrication method for R—Fe—B permanent magnets in accordance with claim 14, whereby the solid lubricant is a lubricant consisting of at least one of zinc stearate, copper stearate, aluminium stearate or ethylene-vinylamido.

16. A fabrication method for R—Fe—B permanent magnets in accordance with claim 1, whereby the composition of the R—Fe—B magnet fine powders is R (that is, at least one of the rare-earth elements including Y) 10~30 at %, B 2~28 at % and Fe 42~88 at % (that is, Fe may be partially replaced by either one or both of Co or Ni).

17. A fabrication method for R—Fe—B permanent magnets in accordance with claim 16, whereby the composition is R 12~16 at %, B 4~12 at % and Fe 72~84 at %.

18. A fabrication method for R—Fe—B permanent magnets in accordance with claim 16, whereby B is partially replaced by no more than a total of 4.0 at % by at least one of up to 4.0 at % of C, up to 3.5 at % of P, up to 2.5 at % of S or up to 3.5 at % of Cu.

19. A fabrication method for R—Fe—B permanent magnets in accordance with claim 16, whereby at least one of up to 9.5 at % Al, up to 4.5 at % Ti, up to 9.5 at % V, up to 8.5 at % Cr, up to 8.0 at % Mn, up to 5.0 at % Bi, up to 12.5 at % Nb, up to 10.5 at % Ta, up to 9.5 at % Mo, up to 9.5 at % W, up to 2.5 at % Sb, up to 7 at % Ge, up to 3.5 at % Sn, up to 5.5 at % Zr or up to 5.5 at % Hf is included as an additive.

20. A fabrication method for R—Fe—B permanent magnets in accordance with claim 1, whereby the sum, A+B, of the magnetic characteristics A, (BH)max(MGOe), and B, iHc (kOe) is greater than 59.5.

21. A fabrication method for R—Fe—B permanent magnets in accordance with claim 20, whereby the sum, A+B, of the magnetic characteristics A, (BH)max(MGOe), and B, iHc (kOe) is greater than 62.

* * * * *